US006276943B1

(12) United States Patent
Boutros et al.

(10) Patent No.: US 6,276,943 B1
(45) Date of Patent: Aug. 21, 2001

(54) MODULAR PLUG CONNECTOR AND IMPROVED RECEPTACLE THEREFORE

(75) Inventors: Kamal Shawiky Boutros, Richmond Hill; Robert Pike, Scarborough; Martian Daniel Dima, Richmond Hill, all of (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/255,004

(22) Filed: Feb. 22, 1999

(51) Int. Cl.[7] ..... H01R 12/00
(52) U.S. Cl. ..... 439/76.1; 439/676; 439/941
(58) Field of Search ..... 439/76.1, 79, 607, 439/620, 660, 344, 676, 677, 941

(56) References Cited

U.S. PATENT DOCUMENTS

| | | | | |
|---|---|---|---|---|
| 3,141,721 | | 7/1964 | Horn | 439/680 |
| 3,408,612 | | 10/1968 | Bute et al. | 439/68 |
| 3,740,698 | | 6/1973 | Jerominek | 439/61 |
| 4,379,606 | | 4/1983 | Clark et al. | 439/76.1 |
| 4,380,360 | | 4/1983 | Parmer et al. | 439/59 |
| 4,397,513 | | 8/1983 | Clark et al. | 439/357 |
| 4,398,779 | | 8/1983 | Ling | 439/64 |
| 4,464,832 | | 8/1984 | Asick et al. | 29/839 |
| 4,519,664 | | 5/1985 | Tillotson | 439/607 |
| 4,629,266 | * | 12/1986 | Viselli | 439/676 |
| 4,781,623 | * | 11/1988 | Philippson et al. | 439/676 |
| 4,781,626 | | 11/1988 | Lazarchik | 439/626 |
| 4,964,012 | | 10/1990 | Kitagawa | 361/113 |
| 4,983,932 | | 1/1991 | Kitagawa | 333/12 |
| 4,992,060 | | 2/1991 | Meyer | 439/620 |
| 5,108,294 | | 4/1992 | Marsh et al. | 439/76 |
| 5,242,310 | | 9/1993 | Leung | 439/76 |
| 5,370,555 | | 12/1994 | Smoravek | 439/620 |
| 5,397,250 | * | 3/1995 | Briones | 439/620 |
| 5,409,385 | | 4/1995 | Tan et al. | 439/76 |
| 5,413,490 | | 5/1995 | Tan et al. | 439/76 |
| 5,477,426 | | 12/1995 | Bethurum | 361/731 |
| 5,502,892 | | 4/1996 | Lien | 29/841 |
| 5,563,770 | | 10/1996 | Bethurum | 361/737 |
| 5,669,789 | | 9/1997 | Law | 439/620 |
| 5,673,181 | | 9/1997 | Hsu | 361/760 |
| 5,764,125 | | 6/1998 | May | 336/92 |
| 5,766,027 | | 6/1998 | Fogg | 439/76.1 |
| 5,769,668 | | 6/1998 | Tondreault | 439/633 |
| 5,797,771 | | 8/1998 | Garside | 439/771 |
| 5,830,001 | | 11/1998 | Kinoshita et al. | 439/354 |
| 5,833,473 | | 11/1998 | Betker et al. | 439/76.1 |
| 6,129,561 | | 10/2000 | Lok | 439/76.1 |

* cited by examiner

*Primary Examiner*—Tulsidas Patel
(74) *Attorney, Agent, or Firm*—Blank Rome Comisky & McCauley, LLP

(57) ABSTRACT

An electrical plug connector includes two separate modules, one of which is an electrical contact module that plugs into the housing, and the other of which is a printed circuit board that is also secured in the housing upon insertion, the contacts of the electrical contact module being arranged to engage terminals of the circuit board upon insertion of the respective modules into the connector housing. The plug connector housing includes a pair of latch arms and a guide slot, the contact module and the circuit board each being arranged to be guided by the guide slot during insertion into the housing, and to capture one of the latch arms upon completion of insertion. To enable the plug connector to be keyed to a specific receptacle, the plug also includes polarization keys, and the receptacle includes corresponding slots whose dimensions and configuration or position serve to key the plug to the receptacle. In addition, the receptacle includes a filter block that snaps into the receptacle housing and surrounds the contacts to provide EMI filtering.

30 Claims, 10 Drawing Sheets

MODULAR PLUG CONNECTOR AND IMPROVED RECEPTACLE THEREFORE

BACKGROUND OF THE INVENTION

1. Field of the Invention

This invention relates to a multiple contact electrical connector, and in particular to an improved High Speed Serial Data Connector (HSSDC) system made up of a modular plug and a receptacle having a polarization slot and a ferrite block filter.

2. Description of Related Art

The HSSDC system was developed to carry data over Ethernet connections at full duplex rates of up to four Gigabits per second, over extended cable lengths of up to ten kilometers. Although not yet subject to a formal IEEE standard, the IEEE draft proposal calls for eight signal lines and, in the case of extended length cable connections, an equalizer board connected between the contacts of the plug connector and corresponding contacts of the cable.

In general, the HSSDC connector design is similar to other network cable connector designs, but the presence of an equalizer board in the plug connector, and the relative high data rates of the proposed HSSDC standard, present a number of new problems. Although the problems are of particular concern with respect to HSSDC connectors, however, those skilled in the art will appreciate that the solutions to the problems may also have applicability to other types of connectors, and in particular to other high speed multiple contact data cable connectors.

The first problem is the difficulty in assembling the contacts of the plug connector to the equalizer board. Currently, both the connector contacts and cable conductors must be soldered to the equalizer board before placement of the entire assembly in the connector housing. As a result special handling of the cable and board is required, greatly complicating the manufacturing process. While modular designs, including modular designs utilizing solderless contact arrangements, have previously been proposed, the prior designs have either pre-positioned the connector contacts in the module, as is common in the case of RJ contacts, or provided a separate circuit board module for various filter components, as in the case of SCSI or RJ connectors. Neither of these two solutions is suitable for use in an HSSDC connector system because of the configuration of the contacts which, unlike RJ contacts, extend generally horizontally from the equalizer board, leaving them vulnerable to damage during assembly, and because of the design of the connector housing which, as a result of the high data rates, must completely enclose the equalizer board, thereby making post assembly termination of the cable to the circuit board impractical.

The second problem is that current assembly techniques require, in the case of connectors that do not include an equalizer board, termination of the connector contacts directly to the cable contacts before insertion into the connector, which requires a separate assembly line. Even if a conventional modular design could be used for such connectors, the problem would remain that separate assembly procedures or different modules are required for equalized and non-equalized connectors.

The third problem is the problem of polarization of the HSSDC system. Because of the wide variety of devices that could use HSSDC type connections, it is possible that devices could be cross-connected. It would thus be desirable to include a way to prevent otherwise identical HSSDC plugs from being plugged into the same receptacle.

Finally, the fourth problem involves the general problem of shielding and filtering the contacts. While the HSSDC cable, plug, and receptacle are all shielded against radio frequency (RF) interference, the currently proposed connector design makes no allowance for filtering out spurious signals that might result from electro-magnetic interference (EMI), which can be significant due to the lengths of cable involved. Because of the unique configuration of the HSSDC system connectors, the advantages of placing an EMI filter within the HSSDC format connector have not previously been recognized, even though EMI filter arrangements are well known in the context of RJ, SCSI, and other less well-shielded cable/connector systems. In addition, conventional filtering arrangements often add significantly to the cost of assembly because of the small size of the filters and the need to terminate them to individual contacts.

SUMMARY OF THE INVENTION

It is accordingly a first objective of the invention to provide a high speed connector system including a plug connector made up of a housing, a plurality of contacts, and a circuit board connected to the contacts, in which the circuit board and contacts may be connected to each other and assembled to the connector using a modular design that does not require any pre-soldering or pre-termination of the contacts to the equalizer board.

It is a second objective of the invention to provide a high speed connector arrangement having a modular snap-together design that permits the printed circuit board to be replaced, so that the same connector plug housing can be used for applications that require equalization circuitry and also for applications that do not require equalization circuitry.

It is a third objective of the invention to provide an HSSDC connector system that includes EMI filtering and polarization features that allow plugs to be keyed to specific receptacles.

These objectives are achieved, in accordance with the principles of a preferred embodiment of the invention, by providing an electrical plug connector that includes two separate modules, one of which is an electrical contact module that plugs into the housing, and the other of which is a board that is also latched in the housing upon insertion of the board, the contacts of the electrical contact module being arranged to engage terminals of the circuit board upon insertion of the respective modules into the connector housing.

In an especially preferred embodiment of the invention, the plug connector housing, contact module, and circuit board include first complementary interengaging structures arranged to guide the contact module and circuit board into their final positions in the housing, second complementary interengaging structures arranged to latch the contact module in its final position, and third complementary interengaging structures arranged to latch the circuit board in its final position. The first interengaging structures preferably include a track extending along a sidewall of the housing, and a rib extending laterally from the contact module and arranged to fit within the track, while the second interengaging structures preferably include a latch arm on the housing extending rearwardly relative to the direction of insertion of the contact module into the housing, the latch arm on the housing having a downwardly extending projection, and a notch at a trailing side of the rib extending laterally from the contact module, the projection extending into the notch to latch the contact module in its final position.

The third interengaging structures preferably include a forwardly extending latch arm on the housing, the latch arm of the third interengaging structures including a projection extending laterally into the path of insertion of the contact module into the housing, and a notch in a side of the circuit board, the projection entering the notch to latch the circuit board into the housing following latching of the contact module into the housing, at which time contacts of the contact module engage terminals on the circuit board to complete interconnection of the contacts with circuitry on the circuit board.

According to the preferred embodiment of the invention, the inclusion of complementary interengaging structures for guiding and latching both the contact module and the circuit board allows the connector to be completed by simply snapping the various parts together. Furthermore, the modular design of the preferred plug connector has the advantage that, if an equalization circuit is not required for a particular connector implementation, the printed circuit board having equalization circuitry can simply be replaced by a printed circuit board with traces that directly connect terminals on one side of the board with terminals on the other side of the board, without having to change the connector assembly procedure.

The objectives of the invention are further achieved, in accordance with the preferred embodiment of the invention, by including polarizing structures on the plug, and corresponding slots in the receptacle, the dimensions of the respective plug structures and receptacle slots serving to key the plug to the receptacle.

Finally, the objectives of the invention are also further achieved in accordance with the preferred embodiment of the invention by including in the receptacle structures that allows a filter block to be easily snapped into the receptacle housing, the receptacle contacts being inserted through an opening in the filter block so that the filter block surrounds the receptacle contacts and thereby provides EMI filtering.

Although the illustrated connector is an HSSDC connector, and some of the features of the invention involve considerations unique to HSSDC connectors, those skilled in the art will appreciate that other features of the invention, such as the modular construction, may have wider applicability, and in particular applicability to high speed data connectors other than those specifically described in the HSSDC draft protocol and previous HSSDC connector proposals.

BRIEF DESCRIPTION OF THE DRAWINGS

FIG. 3 is an isometric view of the plug assembly parts illustrated in FIG. 1, showing an intermediate step during assembly of the illustrated parts.

FIG. 16 is an isometric view of an arrangement for shielding a printed circuit board for use in a plug connector of the type illustrated in FIGS. 1–9.

DETAILED DESCRIPTION OF THE PREFERRED EMBODIMENTS

As illustrated in FIGS. 1–5, the high speed connector plug of the preferred embodiment of the invention includes an insulating housing member 1, a contact module 2, and a printed circuit board 3. Insulating housing member 1 may be made of molded plastic or any other suitable dielectric or electrically insulating material, and includes a forward section 4 for insertion into a corresponding receptacle and rear section 4' in which the contact module 2 and printed circuit board 3 are positioned.

Figure 5:
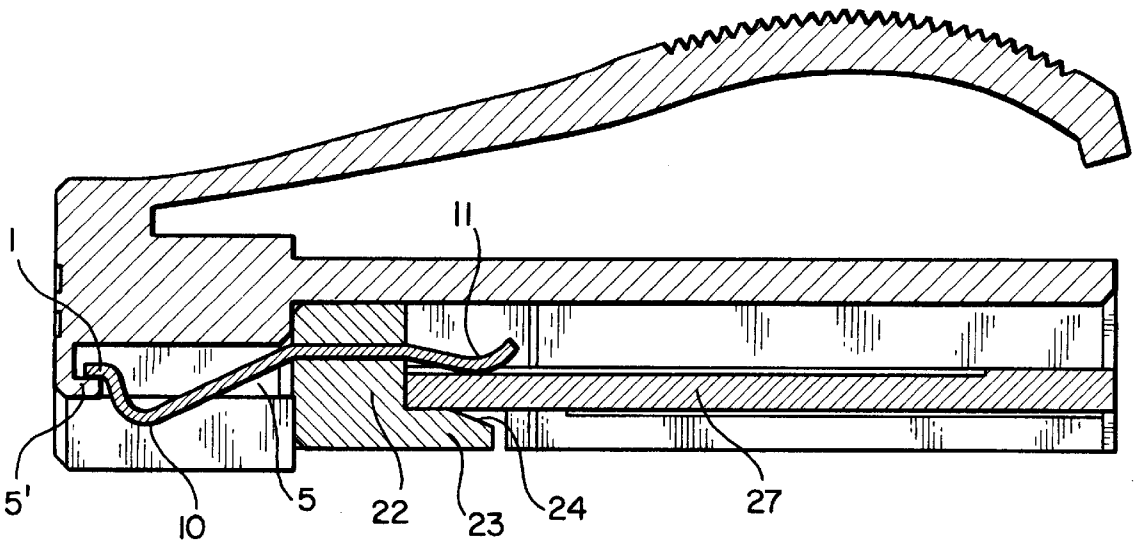
FIG. 5 is a cross-sectional side view of the assembly illustrated in FIG. 4.

Forward section 4 features a plurality of contact positioning slots 5 for receiving forward mating portions 10 of a plurality of contacts 7, and a pair of laterally extending keys 8 which serve to prevent improper insertion of the plug into the receptacle illustrated in FIGS. 10–15. As illustrated in FIG. 5, an inwardly extending shelf 5' extends into slots 5 for supporting forward extensions 9 of the contacts. The rear termination sections 11 of the contacts 7 are also curved to facilitate termination to the printed circuit board 3.

The rear section 4' of the connector housing member 1 is defined by a horizontal planar section 12 from which extends side walls 13. Each of the side walls 13 includes a guide track or slot 14 formed in its inner surface and open at the rear. Guide tracks of slots 14 extend horizontally the length of the respective side walls. Projecting forwardly from side walls 13 and rearwardly from side walls 15 of front section 4 are respective latch arms 16 and 17 which extend into a space between the respective side walls 13 and 15, and which include at their ends respective inwardly extending projections 18 and downwardly extending projections 19 for latching the printed circuit board 3 and contact module 2 in the main housing member 1, as will be described below.

Also included on the main housing member 1 are projections 20 that extend from the outer surface of side walls 13 for securing a shield member, and a latch arm 21 that engages a corresponding opening in the receptacle to latch the plug in the receptacle in known fashion.

Figures 1, 1B:
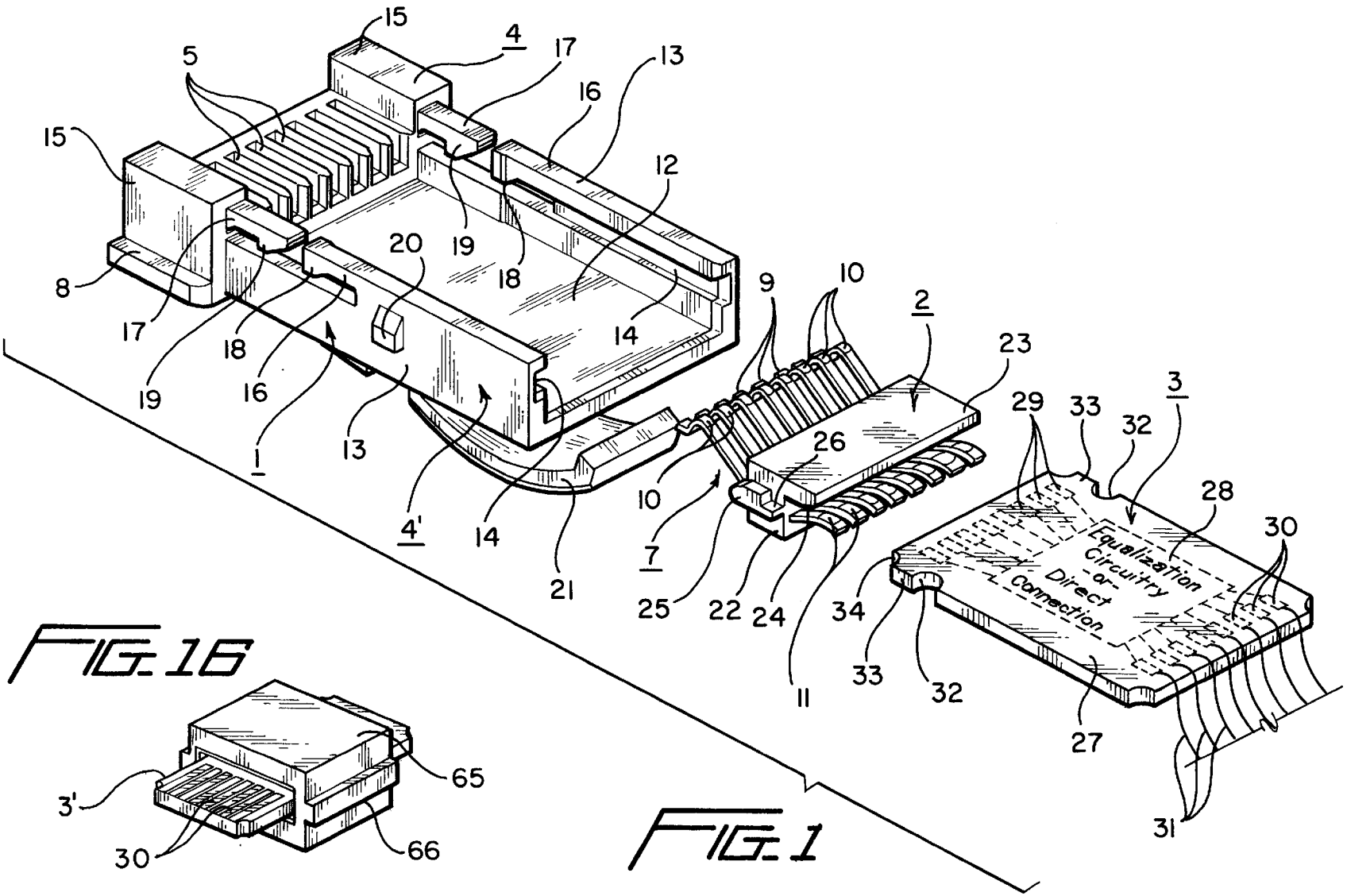
FIG. 1 is an isometric view of various parts of an HSSDC plug assembly constructed in accordance with the principles of a preferred embodiment of the invention.
Figure 2:
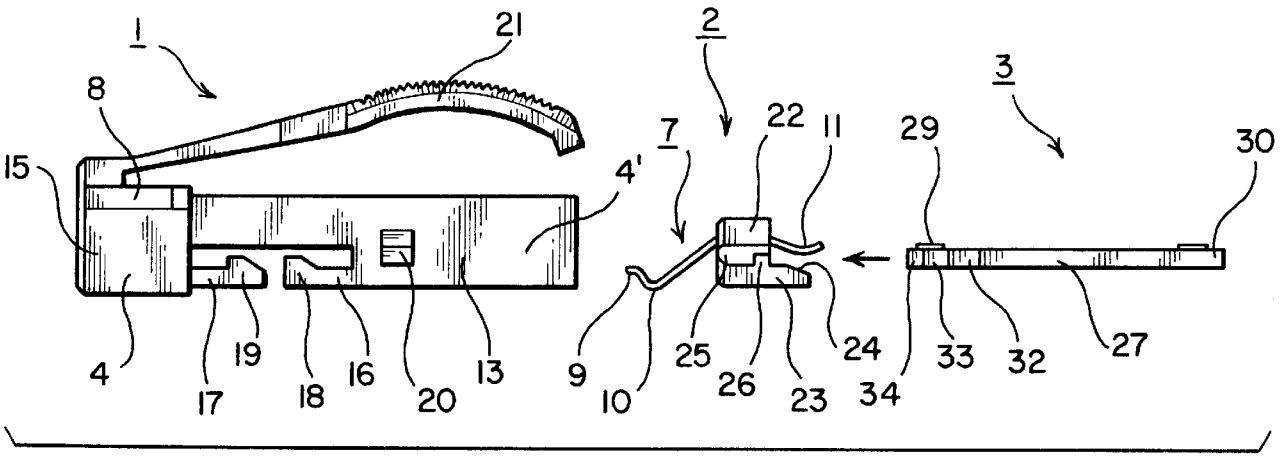
FIG. 2 is a side view of the plug assembly parts illustrated in FIG. 1.

The contact module 2 is made up of an insulating housing 22 formed from a plastic or other dielectric material into which the contacts 7 may, for example, be insert molded, or which may be made up of two parts secured together to capture the contacts therebetween to form a sub-assembly which allows the contacts to be handled as a unit. Contact module housing 22 includes a planar extension 23 having a bevelled surface 24 for receiving the edge of printed circuit board 3 and positioning one side of the circuit board so that terminals 29 engage rear termination sections 11 as is best shown in FIGS. 1 and 2. Terminals 29 are illustrated in dashed lines in FIG. 1 to indicate that they are on the side of the circuit board that faces termination sections 11, as illustrated in FIG. 2.

Projecting laterally from the sides of housing 22 are ribs 25, which are arranged to fit within guide tracks or slots 14 on the inner surface of side walls 13 in order to guide the contact module as it is being pushed into the housing member 1. The trailing ends of ribs 25 includes a notch 26 so that as the contact assembly is inserted into the housing member 1, projections 18 of latch arms 16 engage ribs 25, causing latch arms 16 to be pushed outwardly and allowing the contact module to be pushed past latch arms 16, the notch 26 presenting no obstacle to continued movement of the contact module into the housing member 1. As the contact module is pushed further into the housing member, projections 19 of latch arms 17 engage ribs 25, causing latch arms 17 to be moved upwardly in order to permit ribs 25 to clear the projections until the projections reach notches 26, at which time the projections enter the notches and latch the contact module into the housing member. In order to facilitate movement of ribs 25 past the downwardly extending projections 17 and 19, the leading edges of ribs 25 may be bevelled.

Circuit board 3 is a planar member 27 having a rectangular shape on which is situated circuit elements 28, which may be in the form either of equalization circuitry or simply traces extending directly from terminals 29 at the front of the board, which are engaged by the contacts, to terminals 30 at the rear of the board, to which are connected by any suitable method the conductors 31 of a cable. For purposes of the invention, the configuration of the circuitry or traces on the board is entirely conventional, and therefore is only depicted in schematic fashion. As indicated above, if equalization circuitry is not required, the illustrated board having equalization circuitry may be replaced by a board in which traces directly connect the terminals 29 and 30, allowing the same modular design to be used for connectors with and without the equalization circuitry.

As illustrated in FIG. 16, board 3 may also be replaced by a board 3' that is surrounded by a shielding or filtering element, such as a ferrite block 65, the shielding/filtering element and/or the circuit board being modified as necessary to fit within the connector housing, for example by including rib-like structures 66 on the shielding or filtering element.

The lateral edges of circuit board 3 include notches 32 which are arranged such that, after the contact module has been latched into housing member 1, and the circuit board has been pushed into the housing member by inserting the lateral edges of the circuit board into guide tracks or slots 14, the inwardly extending portions 18 of latch arms 16 clear section 33 of the circuit board before extending into notches 32 in order to latch the circuit board in the connector. To optimize use of space in the housing member, notches 34 may be included at the front of the circuit board so that the front edge of the circuit board can be pushed all the way to the contact module without interfering with downwardly extending projections 19 of latch arms 17.

As a result of the above-described latch and guide track structure, assembly of the contacts 7 and circuit board 3 to the connector housing member 1 simply involves pushing contact module 2 into the housing member until the contact module snaps into place and is held by latch arms 17, and then pushing printed circuit board 3, to which the cable has been pre-terminated by any suitable termination method such as soldering, into the connector housing member until it snaps into place and is held by latch arms 16, at which point rear termination sections 11 of contacts 7 will engage terminals 29 at the front of the board.

Figure 9:
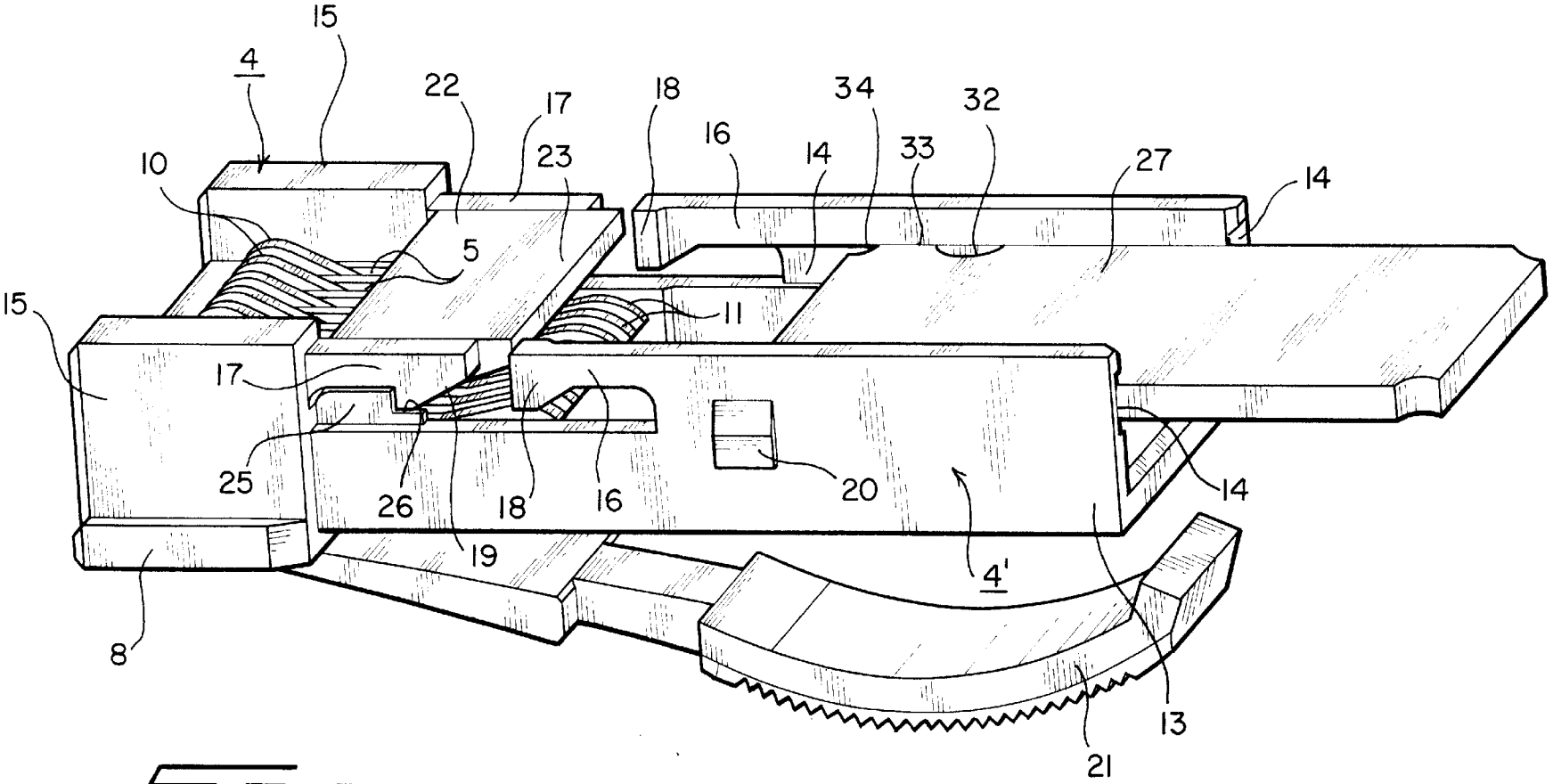
FIGS. 8 and 9 are isometric views showing a completed version of the connector illustrated in FIGS. 1–7.
Figure 4:
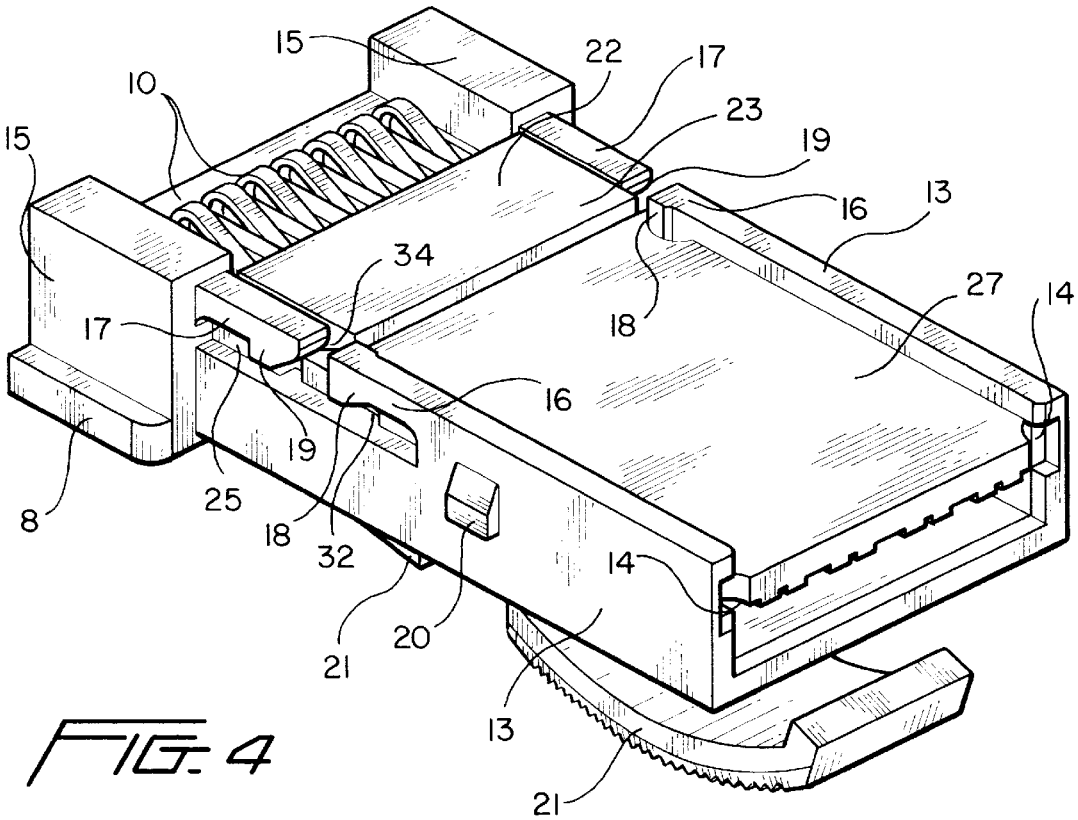
FIG. 4 is an isometric view of the plug assembly parts illustrated in FIG. 1, following assembly.
Figure 6:
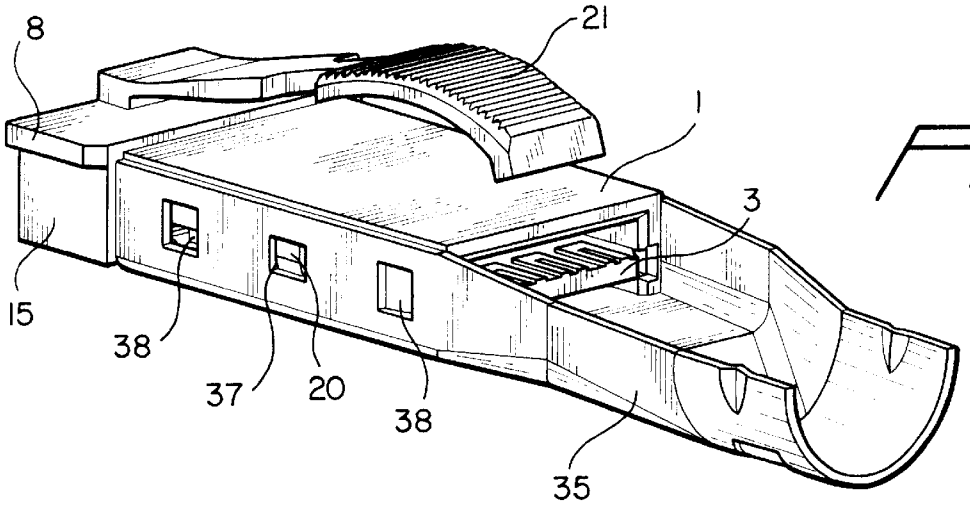
FIG. 6 is an isometric view showing the assembly of FIGS. 4 and 5 following installation of one-half of a metal shield.
Figure 7:
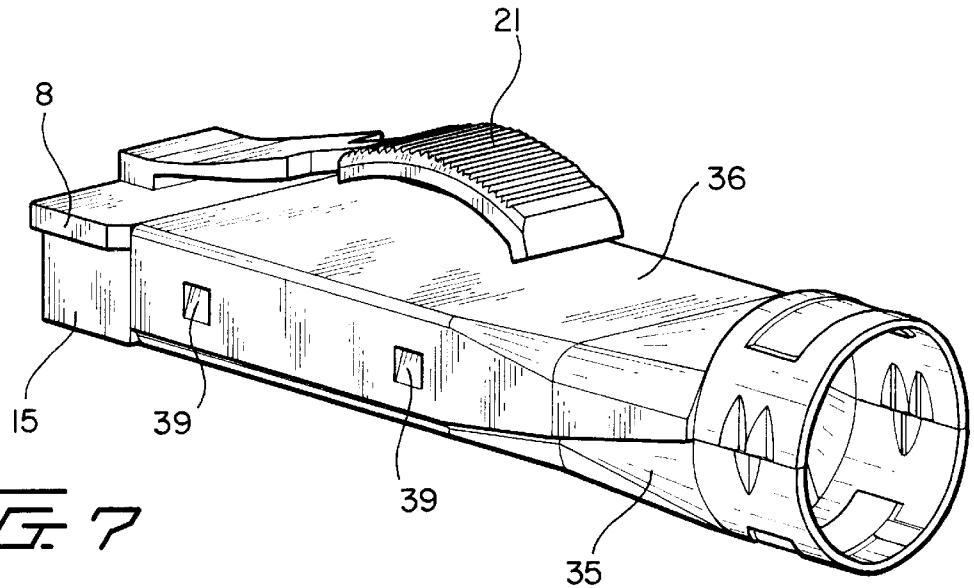
FIG. 7 is an isometric view showing the assembly of FIGS. 4 and 5, following addition of the second shield half.
Figure 8:
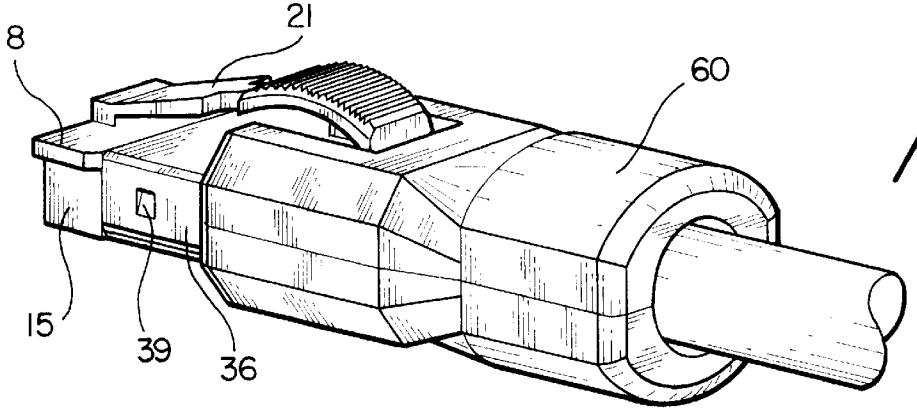
Figure 9:
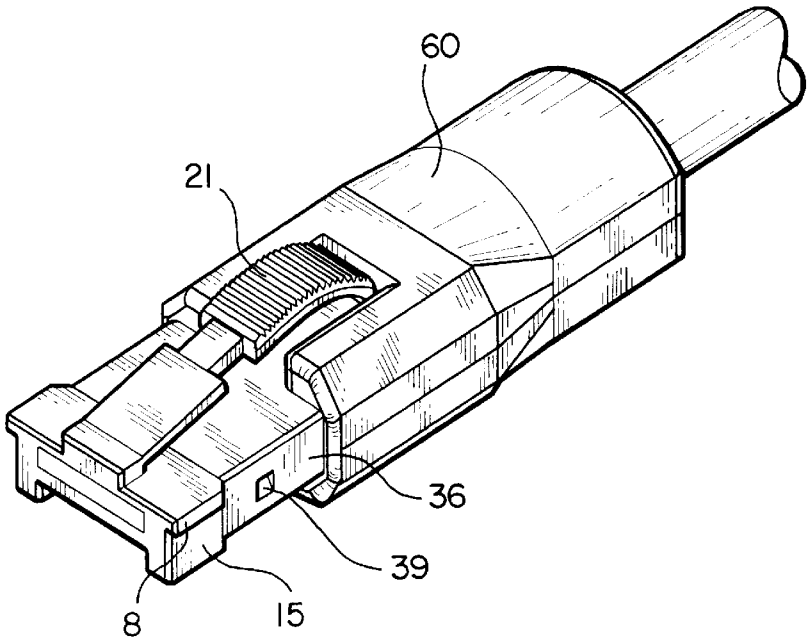

Once the contact module 2 and circuit board 3 have been assembled to main housing 1, the connector is enclosed within a shield which may, as illustrated in FIGS. 6 and 7, include a lower shield half 35 and upper shield half 36. Lower shield half 35 includes openings 37 for receiving projections 20 of housing 1, and openings 38 for receiving inwardly extending latching projections 39 of upper shield half 36, the upper and lower shield halves 35 and 36 overlapping to provide a continuous shielding structure. The shielding structure formed by shield halves 35 and 36 is then enclosed within an insulating outer housing member 60, illustrated in FIGS. 8 and 9, to ensure that the connector can be safely handled by the user, a portion of shield half 36 being exposed so that corresponding elements of the receptacle can engage it and provide shielding continuity when the illustrated plug connector is inserted into a receptacle.

Figure 12:
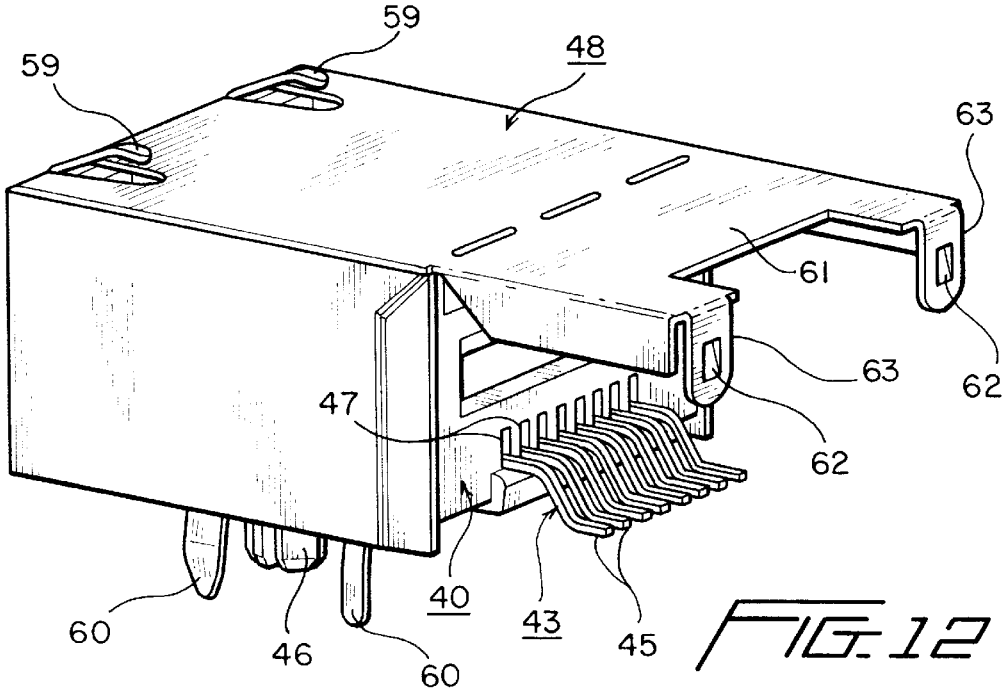
FIG. 12 is an isometric view showing the receptacle of FIG. 11, following assembly of the shield to the receptacle body.
Figure 10:
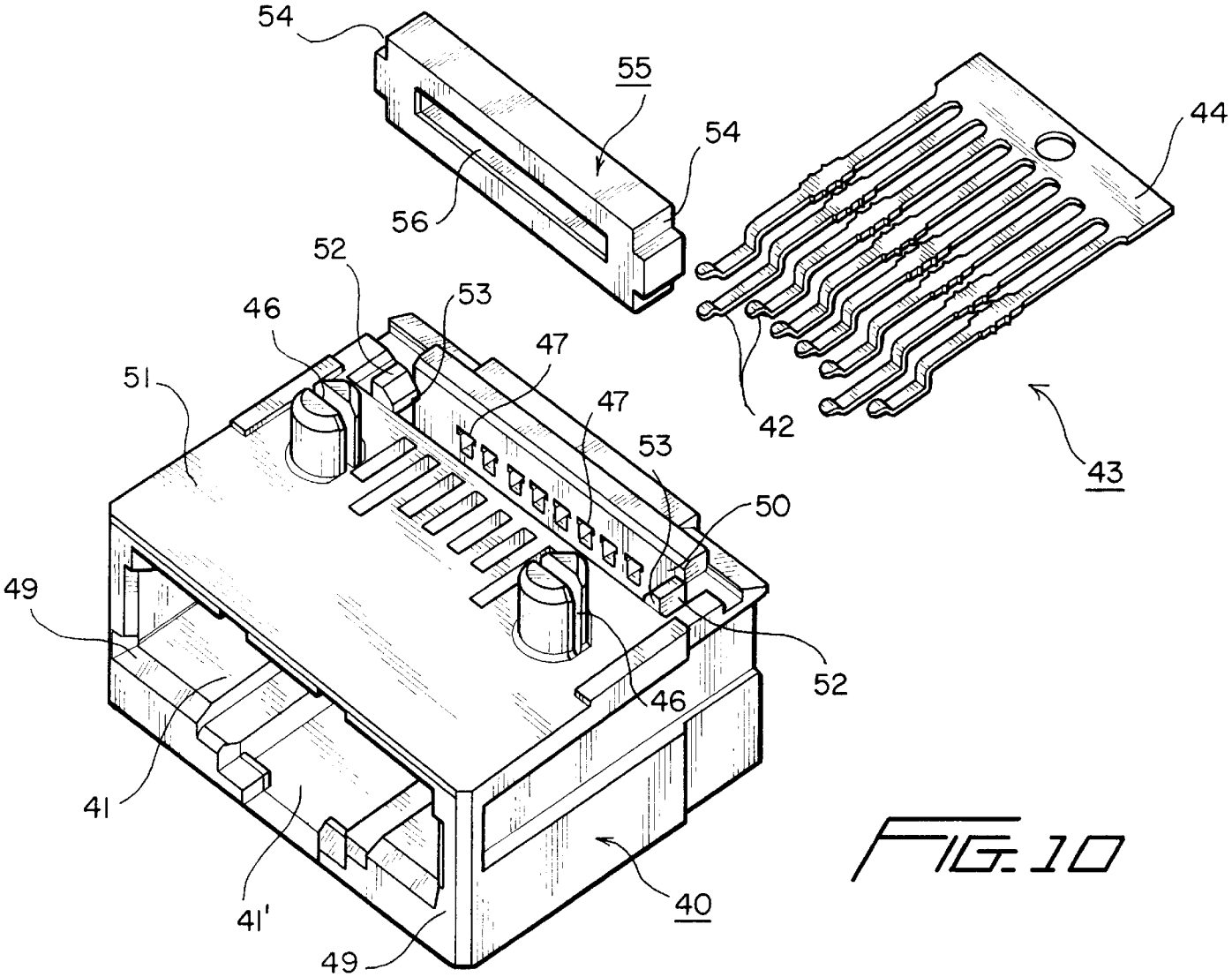
FIG. 10 is an isometric view showing various parts of an HSSDC receptacle constructed in accordance with the principles of a preferred embodiment of the invention.
Figure 11:
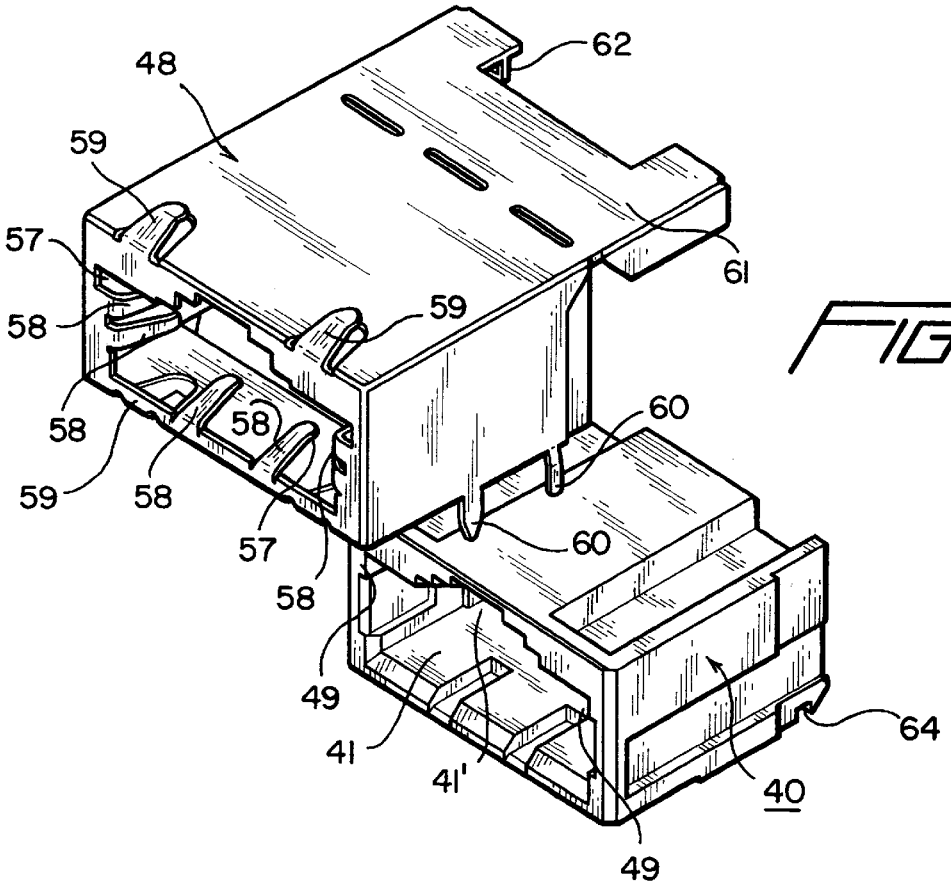
FIG. 11 is an isometric view showing the receptacle body of FIG. 10 together with a shield.
Figure 14:
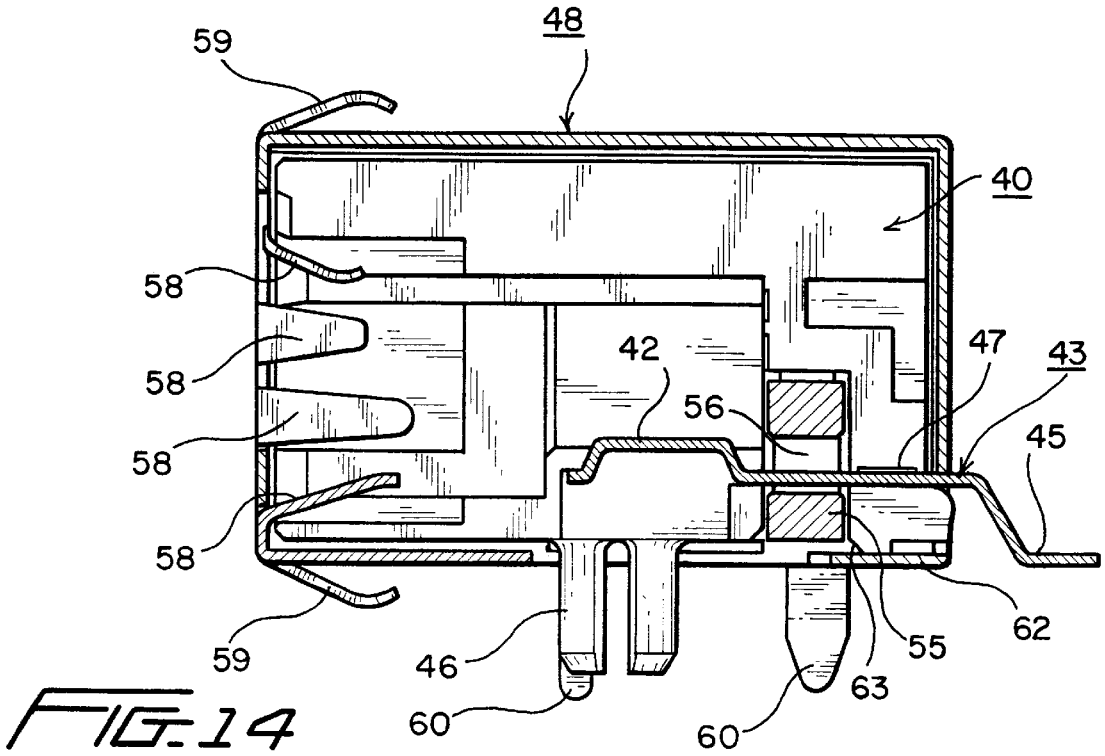
FIG. 14 is a cross-sectional side view of the assembled receptacle of FIGS. 12 and 13.
Figure 13:
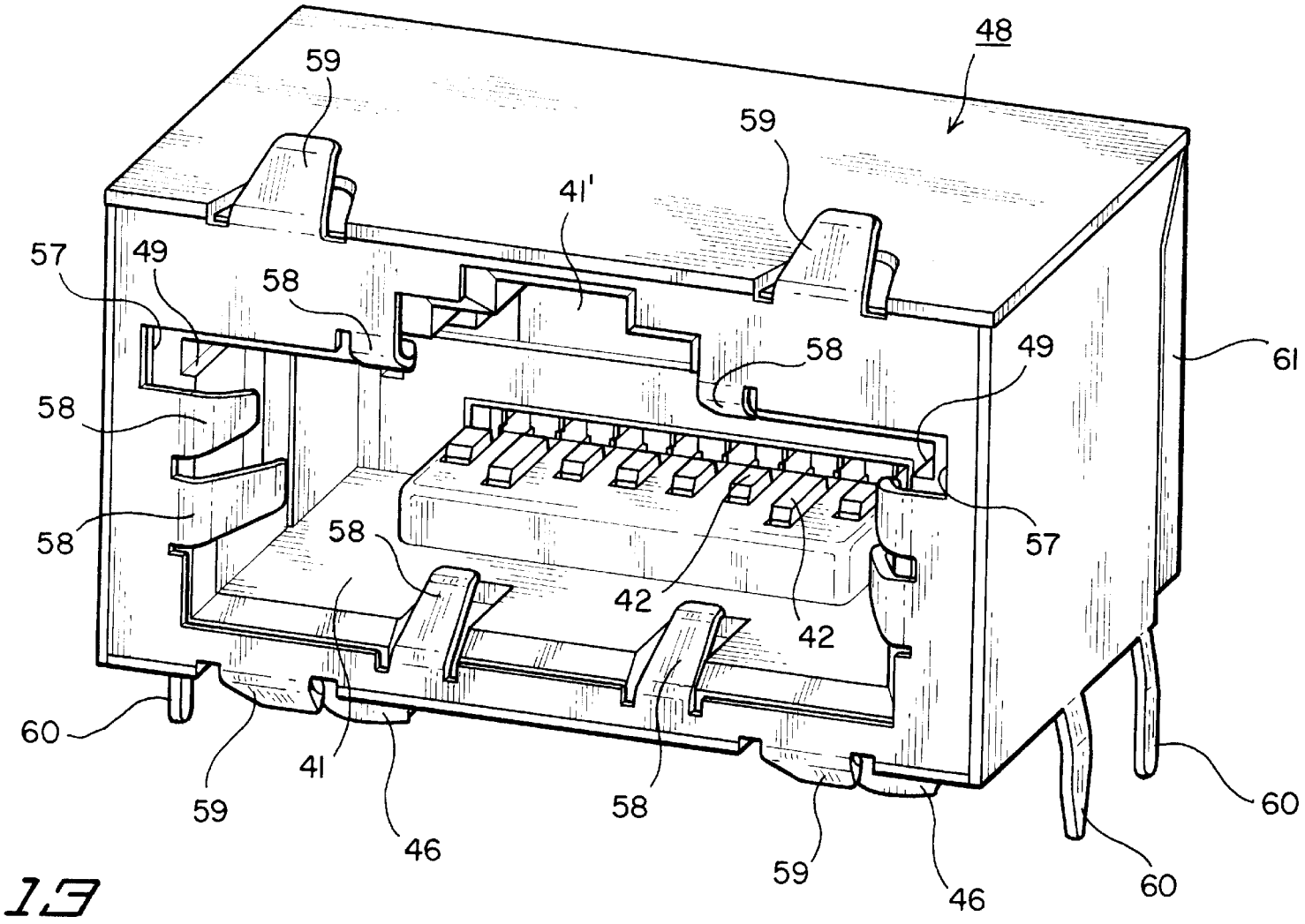
FIG. 13 is a second isometric view of the assembled receptacle of FIGS. 12.

Turning to FIGS. 10–15, the receptacle corresponding to the plug of FIGS. 1–9 includes an electrically insulating receptacle main housing 40 having an opening 41 shaped to receive the plug body 1, including an upper section 41' shaped to receive the latch 21, and into which extends mating portions 42 of contacts 43. Contacts 43 are depicted in FIG. 10 as being joined together by carrier element 44 but, as those skilled in the art will appreciate, carrier element 44 is removed following installation of the contacts in the insulating housing 40. Although the tails 45 of the contacts are illustrated in FIGS. 12 and 14 as being surface mount contact tails, it will also be appreciated by those skilled in the art that the contact tails may also extend downwardly in order to be inserted into openings in a circuit board or card in the fashion of conventional PCB tails.

Receptacle main housing 40 includes board locks 46, openings 47 for permitting passage of contacts 43 from the rear of the housing into opening 41, and various other openings, slots, and other conventional features, not described in detail herein, for supporting the shield 48 and for supporting the contacts 43 within the opening 41.

As described above, the preferred plug connector includes polarizing features in the form of keys arranged to permit individual plugs to be keyed to a specific connector. Receptacle main housing 40 is thus arranged to include polarizing slots 49 extending from the upper corners of the opening, which are shaped and dimensioned to receive polarizing keys 8 of a corresponding plug connector, if properly oriented during insertion. Those skilled in the art will appreciate that while only two keying structures and two keying slots are shown, the number and configuration of the keying structures and slots may be varied to provide multiple key combinations as necessary.

Inclusion of an EMI filter in the receptacle main housing 40 is accomplished, in the preferred embodiment of the invention, by including an opening 50 in the lower surface 51 at the rear of the housing and two downwardly extending latch arms 52 having at their lower distal ends inwardly extending projections 53. Opening 50 extends transverse to the direction of contact insertion across the entire width of the contact assembly. Latch arms 52 are arranged to engage corresponding notches 54 in a filter block 55 inserted through opening 50 into the connector prior to mounting of the contacts, and thereby latch the filter block into the connector. Filter block 55 includes an opening 56 through which the contacts may be inserted, and may be in the form of a ferrite block, a monolithic filter block containing both inductive and capacitive elements, or any other type of EMI filter configuration through which the contacts can be inserted and which can be latched into the receptacle housing before insertion of the contacts.

The shield 48 shown in FIGS. 11–15 is entirely conventional, except for the presents of the polarizing openings 57 corresponding to slots 49 in the main housing 40. Included in shield 48 are ground tabs 58 which extend into opening 41 for engaging the exposed portion of plug connector shield 36 and ground tabs 59 for engaging grounded sections of a panel or device in which the connector is mounted, as well as ground tabs 60 for insertion into openings in a circuit board or card on which the receptacle is mounted. Shield 48 also includes a rear panel 61 which folds over the back of the receptacle housing and is latched, for example by inwardly extending horizontal sections 62 having tines 63, to slots 64 in the receptacle housing in order to complete assembly.

Figure 15:
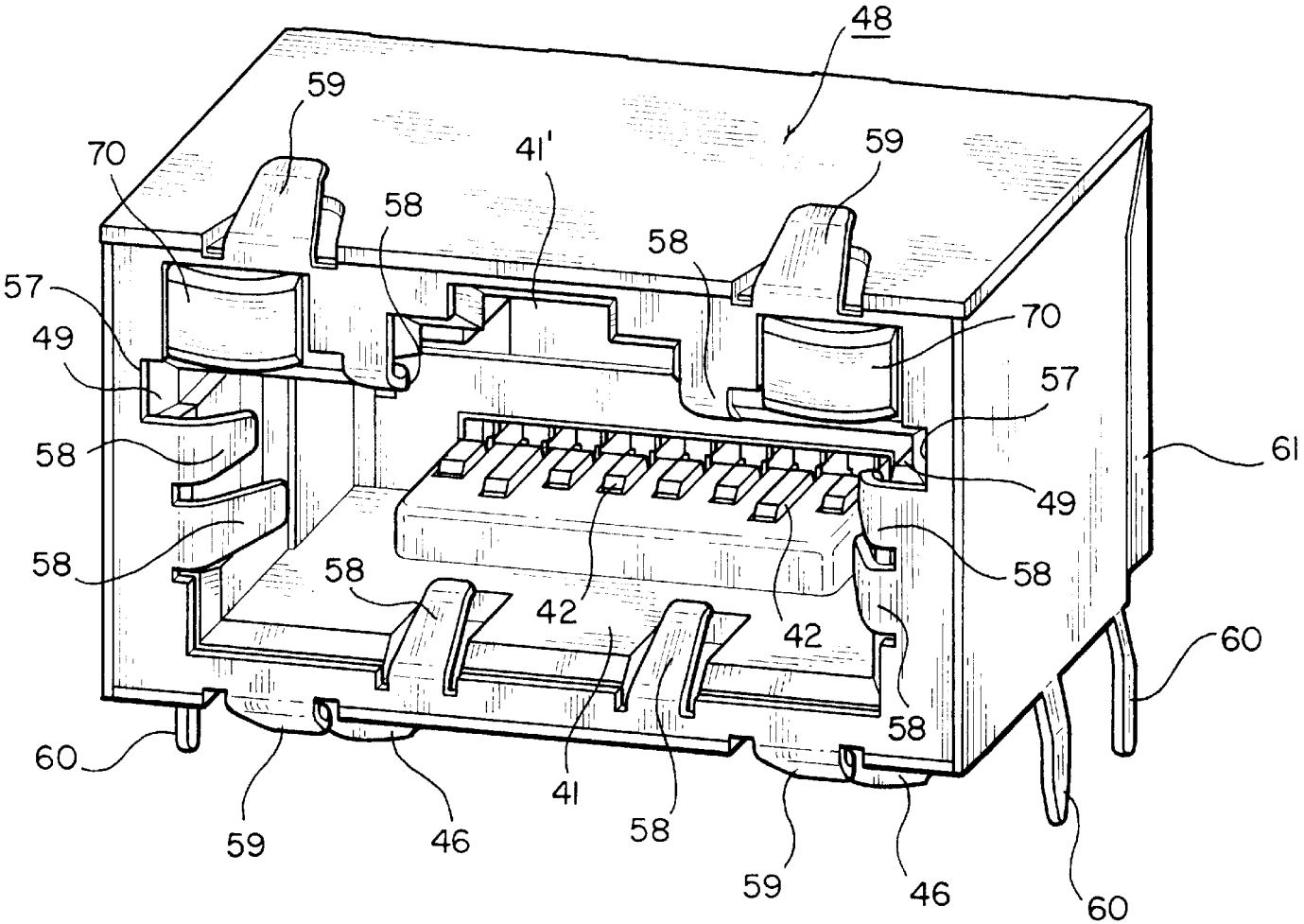
FIG. 15 is an isometric view of a variation of the receptacle of FIGS. 10–14.

The receptacle illustrated in FIG. 15 is identical to that illustrated in FIGS. 10–14, except for the presence of light emitting diodes (LEDs) 70 at the top left and right corners of openings 41, which serve as visual indicators for the connector, and therefore the receptacle illustrated in FIG. 15 has been assigned the same reference numerals as the receptacle illustrated in FIGS. 10–14, and will not be described further herein.

Having thus described preferred embodiments of the invention in sufficient detail to enable those skilled in the art to make and use the invention, it will nevertheless be appreciated that variations and modifications of the illustrated embodiment may be made without departing from the spirit of the invention, for example by adapting the modular design of the preferred plug connector, or the snap-in filter arrangement of the preferred receptacle, to connector systems other than the illustrated HSSDC connector system, and it is intended that the invention not be limited by the above description or accompanying drawings, but that it be defined solely in accordance with the appended claims.

What is claimed is:

1. A modular plug connector for terminating an electrical cable, comprising:

an insulative main housing member;

a contact module; and a printed circuit board, wherein said insulative main housing member and said contact module include first complementary interengaging structures arranged to guide said contact module into a contact module final position within said insulative main housing member, and second complementary interengaging structures arranged to secure said contact module in said contact module final position, wherein said insulative main housing member and said printed circuit board include third complementary engaging structures arranged to secure said printed circuit board in a printed circuit board final position, wherein in said contact module final position and said printed circuit board final position, contacts of said contact module engage terminals on said printed circuit board and wherein said contact module comprised an insulative housing containing a plurality of contacts, said contacts including mating portions extending from a front side of said housing and rear termination portions extending from a rear side of said housing, said rear termination portions contacting said terminals of said printed circuit board when said contact module and printed circuit board are in said final positions, without a need for soldering of said termination portions to said terminals.

2. A plug connector as claimed in claim 1, wherein said first interengaging structures include a track extending along an inner surface of a sidewall of the main insulative housing, and a rib extending laterally from said contact module relative to a direction of movement of said contact module along the track.

3. A plug connector as claimed in claim 2, wherein said second interengaging structures include a latch arm extending rearwardly relative to said direction of movement and having a downwardly extending projection, and a notch at a trailing side of said rib into which said projection extends to latch said contact module in said final position.

4. A plug connector as claimed in claim 3, wherein said third interengaging structures include a forwardly extending latch arm having a projection extending into a path of said contact module, and a notch in a side of said circuit board to latch said circuit board in said circuit board final position.

5. A plug connector as claimed in claim 2, wherein said track is also arranged to guide an edge of said printed circuit board as it is moved to said final position.

6. A plug connector as claimed in claim 2, wherein said second interengaging structures include a latch arm extending rearwardly relative to a direction of movement said contact module and having a downwardly extending projection, and a notch at a trailing side of said rib into which said projection extends to latch said contact module in said final position.

7. A plug connector as claimed in claim 6, wherein said third interengaging structures include a forwardly extending latch arm having a projection extending into a path of said contact module, and a notch in a side of said circuit board to latch said circuit board in said circuit board final position.

8. A plug connector as claimed in claim 1, wherein said third interengaging structures include a forwardly extending latch arm having a projection extending into a path of said contact module, and a notch in a side of said circuit board to latch said circuit board in said circuit board final position.

9. A plug connector as claimed in claim 1, wherein said circuit board includes circuit elements electrically connected between said terminals and conductors of a cable.

10. A plug connector as claimed in claim 9, wherein said circuit elements are elements of an equalizer circuit.

11. A plug connector as claimed in claim 9, wherein said circuit elements are traces directly connecting said terminal and conductors of a cable, whereby the same termination arrangement can be used when said circuit elements include an equalizer circuit and when an equalizer circuit is not required.

12. A plug connector as claimed in claim 1, further comprising a shielding member arranged to fit over said main insulative housing member.

13. A plug connector as claimed in claim 12, wherein said connector is a high speed serial data connector (HSSDC).

14. An electrical connection system as claimed in claim 1, wherein said filter block is a ferrite filter block.

15. An HSSDC system, comprising:

a plug connector for fermmatins an electrical cable and a receptacle connector, said plug connector having a front section arranged to be inserted into an opening in said receptacle connector, wherein said front section includes keying structures extending laterally from said front section, and wherein said receptacle connector includes slots extending laterally from said opening for receiving said keying structures, said keying structures and slots enabling said plug connector to be keyed to a specific receptacle depending on a shape and configuration of said keying structures and slots and wherein said plug connector comprises:

an insulative main housing member;

a contact module; and a printed circuit board, wherein said insulative main housing member and said contact module include first complementary interengaging structures arranged to guide said contact module into a contact module final position within said insulative main housing member, and second complementary interengaging structures arranged to secure said contact module in said contact module final position, wherein said insulative main housing member and said printed circuit board include third complementary engaging structures arranged to secure said printed circuit board in a printed circuit board final position, and wherein in said contact module final position and said printed circuit board final position, contacts of said contact module engage terminals on said printed circuit board.

16. An HSSDC system as claimed in claim 15, wherein said receptacle connector comprises a main housing and a plurality of electrical contacts extending from a rear of said main housing into said opening, said main housing including a lower surface having a slot into which is fitted a filter block, said contacts extending through a central aperture in the filter block.

17. An HSSDC system as claimed in claim 16, wherein said main housing and said filter block include complementary interengaging structures for securing said filter block into said main housing prior to insertion of said contacts through said central aperture.

18. An HSSDC system as claimed in claim 17, wherein said complementary interengaging structures include a notch in said filter block and a latch arm extending into a path of insertion of said filter block into said connector.

19. An HSSDC system as claimed in claim 17, wherein said filter block is a ferrite filter block.

20. An electrical connection system, comprising:

a plug connector and a receptacle connector, said plug connector having a front section arranged to be inserted into an opening in said receptacle connector, wherein said receptacle connector comprises a main housing and a plurality of electrical contacts extending from a rear of said main housing into said opening, said main housing including a lower surface having a slot into which is fitted a filter block, said contacts extending through a central aperture in the filter block, and wherein said slot and filter block include complementary interengaging structures including a notch in said filter block and a latch arm extending into a path of insertion of said filter block into said connector for securing said filter block into said main housing prior to insertion of said contacts through said central aperture.

21. An electrical connection system as claimed in claim 20, wherein said plug connector comprises:

an insulative main housing member;

a contact module; and a printed circuit board, wherein said insulative main housing member and said contact module include first complementary interengaging structures arranged to guide said contact module into a contact module final position within said insulative main housing member, and second complementary interengaging structures arranged to secure said contact module in said contact module final position, wherein said insulative main housing member and said printed circuit board include third complementary engaging structures arranged to secure said printed circuit board in a printed circuit board final position, and wherein in said contact module final position and said printed circuit board final position, contacts of said contact module engage terminals on said printed circuit board.

22. An electrical connection system as claimed in claim 20, wherein said system is a high speed serial data connector (HSSDC) system.

23. An electrical connection system, comprising:

a plug connector and a receptacle connector, said plug connector having a front section arranged to be inserted into an opening in said receptacle connector, wherein said plug connector includes a housing and, mounted within the housing are a plurality of electrical contacts and a printed circuit board arranged to electrically connect said plurality of electrical contacts with conductors of a cable, and wherein said printed circuit board is surrounded by an EMI filter arranged to fit within said housing.

24. A system as claimed in claim 23, wherein said EMI filter is a ferrite filter block.

25. An electrical connection system as claimed in claim 23, wherein said system is a high speed serial data connector (HSSDC) system.

26. A plug connector as claimed in claim 1, wherein said circuit board includes circuit elements electrically connected between said terminals and conductors of an electrical cable.

27. a plug connector as claimed in claim 26, wherein said circuit elements are elements of an equalizer circuit.

28. A plug connector as claimed in claim 26, wherein said circuit elements are traces directly connecting said terminal and conductors of the electrical cable, whereby the same termination arrangement can be used when said circuit elements include an equalizer circuit and when an equalizer circuit is not required.

29. A plug connector as claimed in claim 26, further comprising a shielding member arranged to fit over said main insulative housing member.

30. A plug connector as claimed in claim 29, wherein said connector is a high speed serial data connector (HSSDC).

* * * * *